United States Patent [19]

Fields et al.

[11] Patent Number: 4,868,451

[45] Date of Patent: Sep. 19, 1989

[54] LAMP FILAMENT SUPPORT CONSTRUCTION

[75] Inventors: Larry R. Fields, Richmond; Michael L. Martin, Jeffersonville; Merle E. Morris, Lexington, all of Ky.

[73] Assignee: GTE Products Corporation, Danvers, Mass.

[21] Appl. No.: 285,673

[22] Filed: Dec. 16, 1988

[51] Int. Cl.[4] ..... H01J 9/18; H01K 1/18

[52] U.S. Cl. ..... 313/279; 445/32; 174/138 R; 174/177; 29/631

[58] Field of Search ..... 29/631; 445/32, 33; 313/276, 279; 174/138 R, 177

[56] References Cited

U.S. PATENT DOCUMENTS 1,590,164 6/1926 Harrington ..... 313/276

2,064,490 12/1936 Noble ..... 313/276 X 2,693,024 11/1954 Wold ..... 29/631

3,930,177 12/1975 Marton ..... 313/279

*Primary Examiner*—Kenneth J. Ramsey

*Attorney, Agent, or Firm*—William E. Meyer

[57] ABSTRACT

A method of constructing a filament support member from a single-piece preformed refractory metal wire having at least one loop protrusion formed in the wire and positioned between the ends of the wire. A section of glass tubing is positioned over and supported by the loop protrusion with a head portion of the loop extending beyond the section of tubing. Heat is applied to melt the section of tubing to form an insulating bead at the base of said loop protrusion. The head portion of the loop protrusion is then trimmed to interrupt electrical continuity in the wire and thus electrically isolate the respective ends of the wire.

27 Claims, 7 Drawing Sheets

LAMP FILAMENT SUPPORT CONSTRUCTION

DESCRIPTION

1. Technical Field

The present invention relates in general to electric lamps of the type having one or more filaments, and pertains, more particularly, to an improved support construction for use in a wide variety of lamp types including both single ended and double ended lamp types.

2. Background

There are many lamp designs having filaments whose length, wire size or general design make the filaments susceptible to failure due to shock or vibration, or which may be susceptible to damage by distortion during lamp manufacturing operations such as the press seal operation. Many different coil support constructions have been used in the filament lamps. One coil support construction extends additional outer lead members coupled from the outer lead assembly to provide an electrically isolated weld point for a single piece coil support. This coil support construction is costly and generally cannot be used in small envelopes with little room. Another construction uses a single piece support attached to the filament along the filament length, with the support ends bending away to be trapped in the lamp press seal or tip; alternatively, the support ends are held against the bulb wall by spring tension. These support constructions have been difficult to accurately position and hold during the sealing operation.

A common support construction uses a bridge assembly in which electrically isolated elements are trapped in bars or lumps of an insulating material such as glass. At present, bridge assemblies are generally costly and require complicated equipment for manufacture. Also, due to their relatively large size, they cannot be incorporated into lamps having limited space, or small envelope size.

Prior art patents that illustrate some general forms of bridge construction are U.S. Pat. Nos. 2,633,548 to Kramel; 2,877,375 to Pearson and 4,039,885 to van Boekhold et al. All of these patents describe the use of wire connecting elements separated by an insulating glass bead. The van Boekhold et al patent in particular describes the use of separate wire leads inserted in a glass sleeve in which the glass sleeve is then melted to form a glass bead. These prior art bridge constructions, in addition to being generally complex in construction, unfortunately, generally require correctly holding two or more formed metal wires or parts, while either inserting them in a bead of molten glass, or applying the molten glass from a dispenser. The handling of two or more metal wires in particular complicates accurate manufacture of the support member.

DISCLOSURE OF THE INVENTION

Accordingly, it is an object of the present invention to provide an improved lamp filament support construction having two or more electrically isolated support wires constructed from a single preformed wire.

Another object of the present invention is to provide a lamp filament support construction simple to manufacture, not requiring complicated and expensive equipment such as is presently used in the construction of many bridge supports.

A further object of the present invention is to provide a lamp filament support construction which can be inexpensively manufactured and is characterized by simple handling during manufacture, requiring a minimum number of parts to form the support construction.

Another object of the present invention is to provide a single lamp filament support construction having a single or multiple electrically isolated support sections.

Still another object of the present invention is to provide a lamp filament support construction which can be incorporated in applications where space limitations make other methods impractical or difficult to use.

A further object of the present invention is to provide an improved lamp filament support construction particularly for those lamps having fragile or shock susceptible filaments, including small wire types such as those designed for operation above 60 volts.

In accordance with a main aspect of the invention, there is provided an improved lamp filament support construction and associated method of construction. The filament support is used to support or position a filament in an electric incandescent lamp. A single piece, preformed refractory metal wire is provided having at least one loop protrusion and disposed between the wire ends. First and second separated sides of the loop are formed on the sides adjacent the head of the loop. A section of insulating material such as a short section of glass tubing is provided and is disposed about the loop protrusion between the first and second sides, leaving the head of the loop exposed. The loop protrusion may be conveniently used to support the insulating material. Heat is supplied to melt the insulating material between and about the sides of the loop to form an insulating bead coupling between the sides of the loop. Finally, the head of the loop, extending from the rehardened bead of insulating material is trimmed or cut to interrupt electrical continuity in the wire and electrically isolate the respective ends of the wire. In several of the embodiments described in further detail hereinafter, the loop protrusion extends in a direction substantially transverse to a line joining the ends of the wire. In several of these embodiments the metal wire is also preformed with opposite ends having straight sections with the loop protrusion disposed intermediate the straight wire sections. The refractory metal wire may be constructed, for example, from molybdenum or tungsten.

In further embodiments described herein, the preformed refractory metal wire may be provided with a plurality of loop protrusions disposed along the length thereof. In this instance there are also provided a plurality of separate tubing pieces with each piece disposed over a corresponding loop protrusion. During the heating step, each tubing piece is melted to form a corresponding bead associated with each loop protrusion. The individual loop protrusions are then trimmed to provide multiple sections of electrically isolated wire, each section of which may contain a support feature.

The finished support member can be held in place by joining it at any point along its length to a part of the filament or associated mount assembly. In particularly, it may be welded to the molybdenum sealing ribbon or joined to a coil leg by welding or by a coil overwind. Precision formed loops in the wire parts may be fitted around the filament or other lamp parts as required by the particular application. In one version of the invention, the wire has a loop formed at both ends, so the finished part can be attached between coil legs or other lamp parts to secure the orientation of these parts such as during manufacturing operations such as the press seal operation.

One of the advantages of the method of construction of the present invention is that, with the single piece, preformed refractory metal wire, once the section of insulating material has been inserted about the loop protrusion, the loop protrusion itself forms a support to hold the remaining parts in place. For example, the wire may be supported on a rod or other fixture while the components pass through a furnace or in contact with a heat source for melting of the glass tubing. Trimming the loop head may then take place as a last step before use in a lamp. There is no need to provide special complicated support means for multiple wires in association with the insulating material.

BRIEF DESCRIPTION OF THE DRAWINGS

FIGS. 6A–5E illustrate alternative clipping structures for the insulating material.

DESCRIPTION OF PREFERRED EMBODIMENTS

For a better understanding of the present invention together with other and further objects, advantages and capabilities thereof, reference is made to the following disclosure and appended claims in connection with the above described drawings.

The lamp element support construction of the present invention is illustrated in association with a number of different embodiments to be described herein. In all of these embodiments the filament support is constructed using a preferred single piece preformed wire part, preferably of refractory metal wire such as a tungsten or molybdenum wire used in association with sections of insulating material preferably of glass tubing to form electrically isolated sections of the support member. The preformed part or wire is made with protrusions in the form of one or more loops around which glass or other insulating material may be flowed. After the glass or insulating material has hardened, an end section of the wire protrusion is cut away to create electrically insulated wire sections. The loop may be formed according to the users convenience. The loop should have a first side and second side near enough, but still separated so the separation distance may be bridged by insulating material. It is also convenient that the loop have sides that run approximately parallel with one another, allowing a ring of insulating material to be slipped over, and along the length of the loop. Still a further convenience is to form the loop with a transverse base section. The transverse base section acts as a stop to correctly position the insulating material. Other bridging structures may be used to link the separated loop sides with a bridge of insulating material.

The manufacture of the support member of this invention is simplified by the preformed part, in that the wire protrusion allows a correct amount of an insulating material, such as glass to be placed accurately near or coupled adjacent the area where insulation is desired. With the melted tubing in place, the wire protrusion may also continue untrimmed during subsequent manufacturing stages to be used as a support means, holding the part in place on a rod or other fixture while it passes through a furnace or in contact with a heat source which facilitates the melting and flowing of the insulating material around and between the various sides of the wire protrusion. After the part is removed from the furnace or heat source, the exposed head of the protrusion may be trimmed away to form separate insulated sections of the metal part. The insulated sections are still mechanically held in position by the bead of glass or other insulating material. Each separated metal section may then be joined to electrically active lamp parts without adversely effecting lamp operation.

Figure 1E:
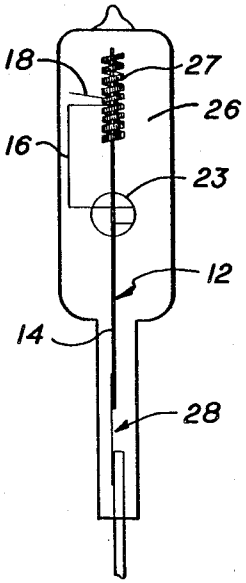
FIGS. 1A–1E illustrate a first embodiment of the present invention, illustrating the sequence of steps in the manufacture including final application in a lamp.
Figure 1D:
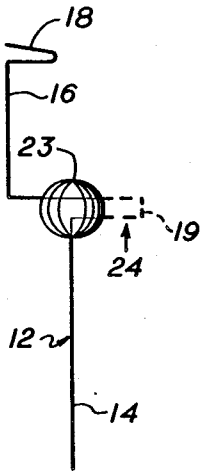

Reference is now made to FIGS. 1A–1E for a first embodiment of the present invention illustrating in sequence the steps in the manufacture of a lamp filament support construction such as shown in its final step in FIG. 1D, and shown in position in a lamp as illustrated in FIG. 1E.

Figure 1C:
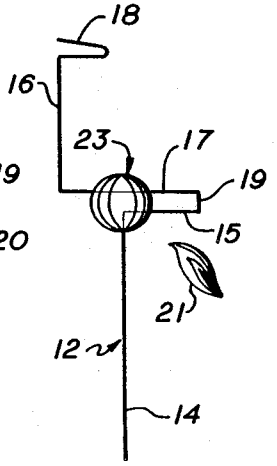
Figure 1B:
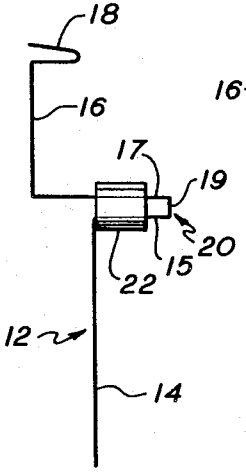
Figure 1A:
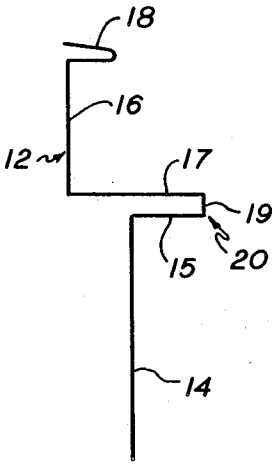

FIG. 1A shows a single piece, preformed refractory metal wire 12 having a first straight end section 14 and a second straight end section 16 terminating in a hook 18. Intermediate the straight sections 14 and 16 is a loop protrusion 20 with separated sides 15, and 17 adjacent the head of the loop 19.

FIG. 1B illustrates the same wire 12 and further illustrates a section of insulating material with an aperture, such as a section of glass tubing 22 disposed over the loop protrusion 20. The head section 19 of the loop protrusion 20, extends beyond the top end of the glass tubing 22.

FIG. 1C illustrates the next step in the manufacturing sequence, applying heat, as illustrated by the arrow 21. With the sides 15, and 17 approximately parallel and separated, and with the glass tubing 22 bridging between the sides to leave the head of the loop 19 exposed, heat 21 is applied to the glass tubing 22, melting the glass tubing 22 to form melted glass bead 23. The sides 15, 17 are captured by the glass bead 23, but the head of the loop 19 is left exposed. FIG. 1D illustrates the next step after the bead 23 has been formed, of trimming the exposed head of the loop 19 at 24 to electrically open up the wire 12 and thus provide electrical isolation between the wire sections 14 and 16.

FIG. 1E shows an envelope 26 enclosing a lamp filament 27 supported on a mount 28. FIG. 1E also shows the filament or coil support member with the straight section 12 welded to the mount 28 and with the hook 18 associated with electrically isolated section 16 engaged with the filament 27. FIG. 1E also illustrates the glass bead 23 interconnecting the two, now electrically separated, wire support sections 14 and 16.

Figure 2A:
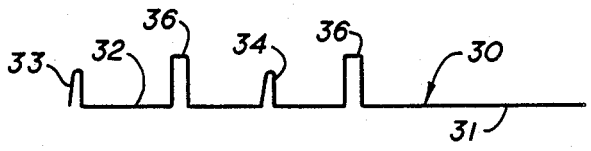
FIGS. 2A–2E illustrate a second embodiment of the Present invention, illustrating the sequence of steps in the manufacture and including the final lamp application.
Figure 2B:
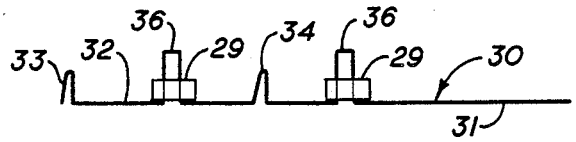
Figure 2C:
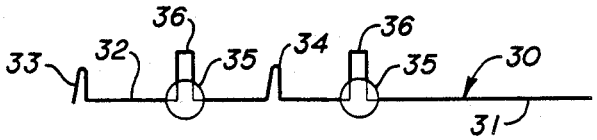
Figure 2D:
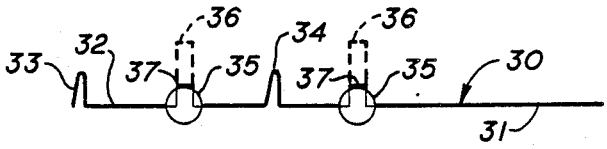
Figure 2E:
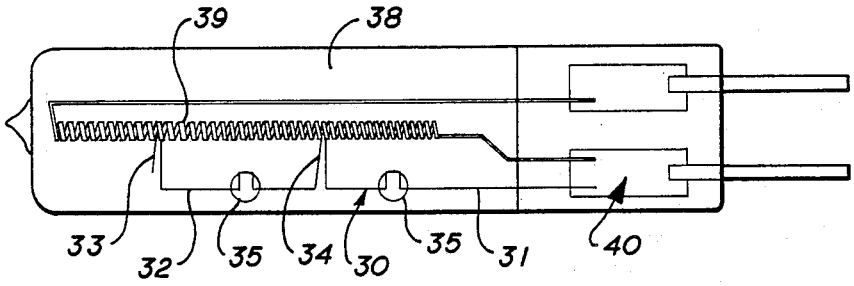

FIGS. 2A–2E illustrate the steps of formation, and final use of a second embodiment of the present invention in a single ended lamp whose filament is supported at multiple positions along its length. FIG. 2D illustrates the final construction of the filament support. FIG. 2E illustrates the use of the coil support in a lamp.

FIG. 2A illustrates a single piece of preformed refractory metal wire 30 having a first straight end 31, a second straight end 32 at the opposite end including a hook piece 33 and further including a second hook piece 34 and several similar loop protrusions 36 intermediate respectively the first straight end 31, and hook 34, is one loop protrusion 36, and intermediate hook 33 and hook 34 is a second, similar loop protrusion 36. In this particular embodiment there are two such similar loop protrusions 36, but a larger number of similar protrusions may be included.

FIG. 2B illustrates the glass tubing sections 29 positioned about the loop Protrusion 36. In this particular embodiment two pieces of tubing 29 are used, one each associated with and disposed over each of the loop protrusions 36. It is convenient, but not necessary to let the tubing rest at the base of each of the loop protrusions 36. It is also convenient that the loop protrusion extend transverse to the straight end sections. The straight sections then act as a stop to position the insulating material against. The loop protrusions 36, as noted extend beyond the glass tubing pieces to be exposed at a head portion.

FIG. 2C illustrates the next step in the manufacturing process in which heat has been applied to melt the tubing pieces 29 to form the glass beads 35 disposed about, and between the sides of the loops 36. The next step, illustrated in FIG. 2D, shows the step of trimming the head of the loop protrusions 36 at 37 to electrically open up the different wire sections and isolate them, one from the other while continuing to mechanically hold and position the wire sections.

Finally, FIG. 2E illustrates the particular filament support in place in a lamp envelope 38 that also supports the elongated lamp filament 39 coupled to the mount 40. In FIG. 2E the lamp filament support wire 30 is shown secured at hooks 33 and 34 to the filament coil 39. At the lower end of the wire 30, the section 31 is preferably welded to one of the foil strips of the mount construction.

Figure 3A:
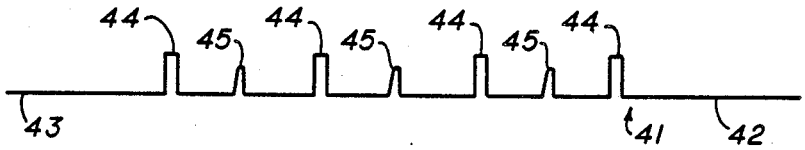
FIGS. 3A–3E illustrate a third embodiment of the present invention, illustrating the sequence of steps in the manufacture as well as the final lamp application.
Figure 3B:
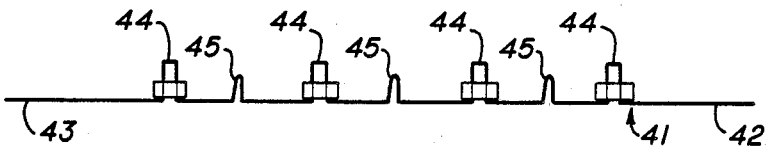
Figure 3C:
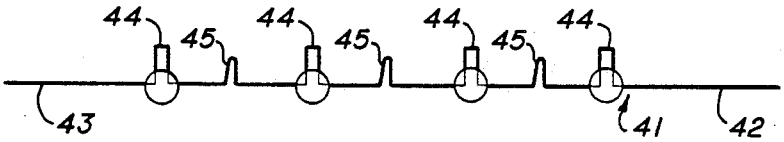
Figure 3D:
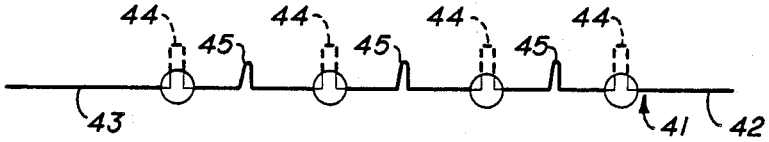
Figure 3E:
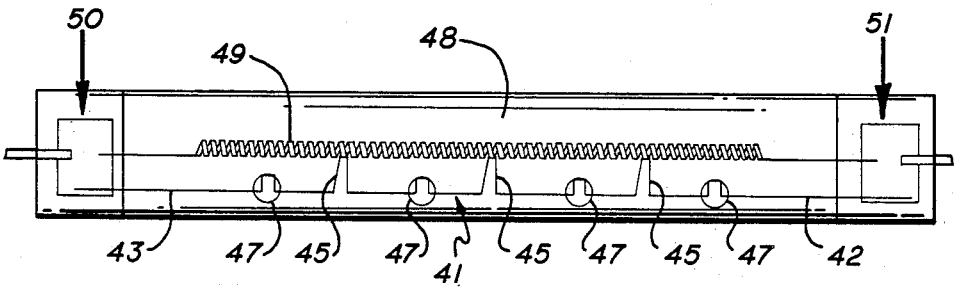

FIGS. 3A–3E illustrate the steps of formation, and final use of a further embodiment of the present invention. FIG. 3D in particular illustrates the finished support construction. FIG. 3E shows the filament support used in a particular lamp configuration, and, in this particular case, a double ended lamp having a filament coil supported at multiple positions along its length from mounts extending from both ends of the lamp.

The particular configuration of the refractory metal wire in FIG. 3A is similar to that illustrated in FIG. 2A. In this particular embodiment the wire 41 has opposite straight ends 42 and 43 and further has a plurality of (four) similar loop protrusions 44. Alternating between the successive loop protrusions 44 are support hooks 45.

FIG. 3B illustrates the glass tubing pieces 46 appropriately disposed over the loop protrusions 44. In this particular embodiment the four loop protrusions 44 are bridged by a corresponding number of glass tubing pieces 46. FIG. 3C illustrates the next step of heating the glass tubing 46 to form corresponding beads 47, one each positioned at the base of each of the loop protrusions 44.

FIG. 3D illustrates the next step in the formation of the filament support member. After the last bead 47 has been formed, the heads of the loop protrusions 44 are trimmed to electrically open up the wire at each glass bead 47 to wire junction to form separate, in this case five, isolated support sections between the ends 42 and 43.

FIG. 3E illustrates the lamp filament support construction of FIG. 3D in place in a particular lamp envelope 48. In the lamp envelope 48 there is provided a filament coil 49 with an elongated construction and supported at either end by respective mounts 50 and 51. In this embodiment, the hooks 45 may be pinched to and thereby support the filament 49. The straight end sections 42 and 43 of the support member are secured, for example by welding, to the corresponding respective end mounts 50 and 51.

Figure 4A:
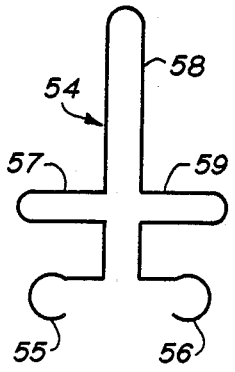
FIGS. 4A–4E illustrate a fourth embodiment of the present invention, illustrating the sequence of steps in the manufacture and including the final lamp application.
Figure 4B:
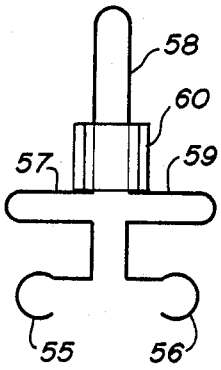
Figure 4C:
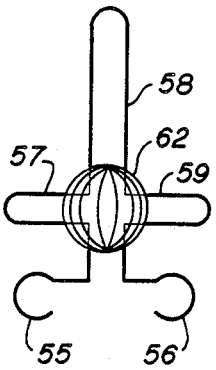
Figure 4D:
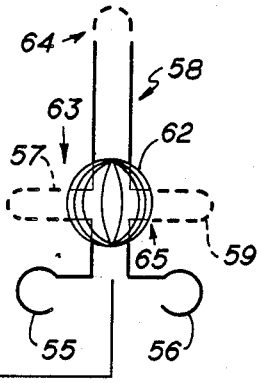
Figure 4E:
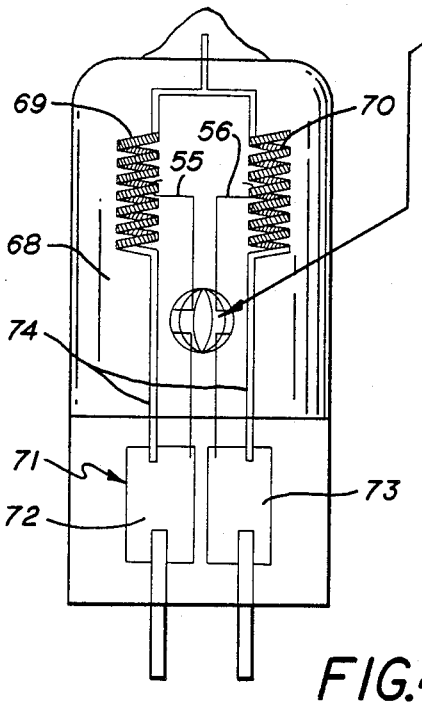

FIGS. 4A–4E illustrate stages of formation, and the final use for a fourth embodiment of the present invention. This particular embodiment differs from the previous ones described in that the loop protrusions extend in different and opposing directions. FIG. 4D shows the final manufactured version of the lamp filament support construction. FIG. 4E shows the support member in its application in a particular lamp construction FIG. 4A illustrates a single piece, preformed refractory metal wire configuration 54 having hooked ends 55 and 56 and three loop protrusions 57, 58 and 59 disposed substantially in a rectangular cross configuration. FIG. 4B shows a section of glass tubing 60 disposed over the loop protrusion 58 but supported at its base adjacent the bases of loop protrusions 57 and 59.

FIG. 4C shows the heating step in the manufacturing sequence in which the glass tubing piece is melted to form a glass bead 62. The insulative material is shown having melted, and flowed between and about the separated side sections of all three of the loop protrusions 57, 58, and 59. Finally, FIG. 4D shows the step in which the heads of the loop protrusions 57, 58, and 59 have been trimmed. The loop protrusion 57 is trimmed at 63, the loop protrusion 58 is trimmed as 64, and the loop protrusion at 59 is trimmed at 65, all as illustrated in FIG. 4D. Four separate wire segments, all of which are relatively insulated from each other, are left protruding from and supported by a single glass bead 62.

In FIG. 4E there is shown the application of this particular support construction to a lamp including an envelope 68 for supporting a filament construction including filament coils 69 and 70. There is also provided a mount construction 71 that includes separate mounting seals 72 and 73. The open leads 74 corresponding to the separated sides of the trimmed loop 58 are coupled to the mounting seal strips 72 and 73, and partially captured in the press seal, as shown. The hooked ends 55 and 56 of the support construction connect to and support the respective filament coils 69 and 70, as illustrated.

Figure 5A:
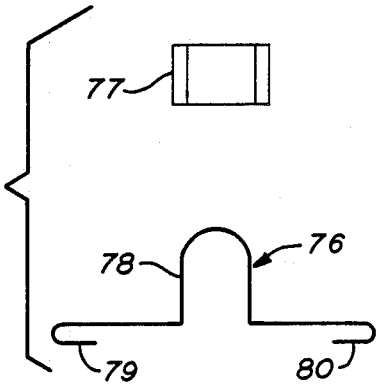
FIGS. 5A–5D illustrate a fifth embodiment of the present invention, illustrating the sequence of steps in the manufacture and including the final lamp application.
Figure 5B:
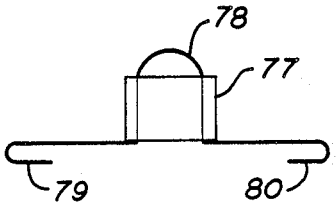
Figure 5C:
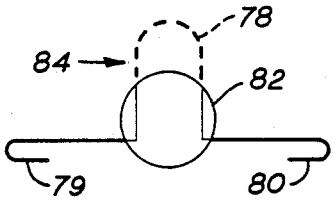

FIGS. 5A–5D illustrate a simple embodiment of the present invention. FIG. 5A illustrates both a single piece, preformed refractory metal wire 76, and a ring of glass tube 77. The wire 76 has a single loop protrusion 78 and has turned ends 79 and 80. FIG. 5B illustrates the next step in manufacture, wherein the glass tube 77 is disposed over the loop protrusion 78. Next, in FIG. 5C, the glass tubing 77 is melted to form a glass bead 82. FIG. 5C also illustrates the loop 78 with the head of the loop 78 trimmed at 84. Again, once the loop has been trimmed, leaving two electrically separate and isolated end sections of the wire extending from the insulating glass bead 82. The hooked and electrically separated wire sections may be used as a bridge section between filament leads.

Figure 5D:
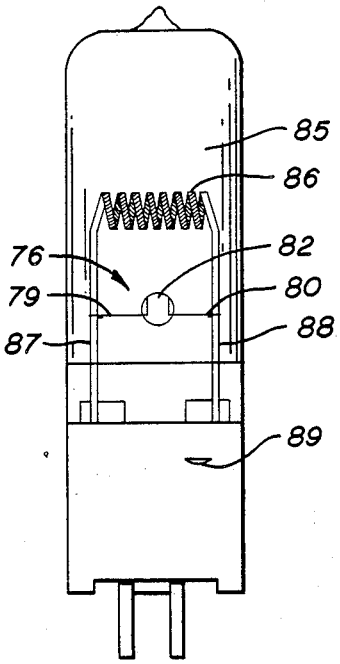

FIG. 5D illustrates the application of this particular support bridge construction in a lamp including a lamp envelope 85 and a filament coil 86. Filament coil 86 is supported by leads 87 and 88 coupling to a mount construction 89. Between the leads 87 and 88 there is disposed the wire support bridge. The turned ends 79, 80 of the support member may be secured to the respective filament leads 87 and 88 by pinching the hooked ends closed.

Figure 6A:
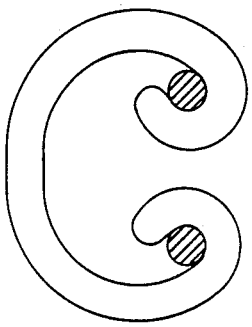
Figure 6B:
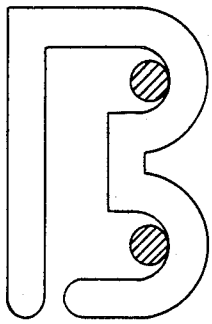
Figure 6E:
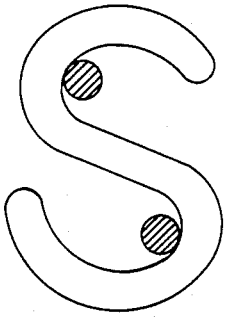
Figure 6C:
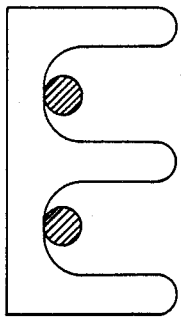
Figure 6D:
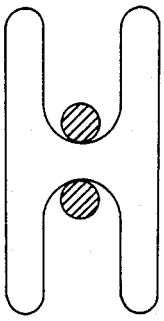

For some support structures, parallel, offset sides may not be a convenient structure. In which case a ring of insulating tubing may not bridge between the adjacent sides. An alternative is to use a clip of insulating material to bridge between adjacent but separate sides of the wire. FIG. 6A–E shows several alternative clip structures intended to be coupled from the side of the loop protrusion or other wire structure, and not disposed over the head end of a loop protrusion . FIG. 6A shows a view, transverse to the wire sections of a "C" shaped clip that may be hooked across the adjacent wire sides, particularly where the ends of the "C" hook back to form traps. FIG. 6B shows an "B" shaped clip, FIG. 6C shows an "E" shaped clip, FIG. 6D shows an "H" shaped clip, and FIG. 6E shows an "S" shaped clip, all of which may be used to bridge between sides of the support. Similar clips may be devised having an opening, and offset positions to located two or more support sections bridged by a meltable insulating material such as glass. The side clipping bridges are less preferred because of the difficulty in easily and accurately positioning them, and because of the possibility of subsequently falling free. Nonetheless, the side clipping bridges are felt to have general utility in the described method.

Figure 7:
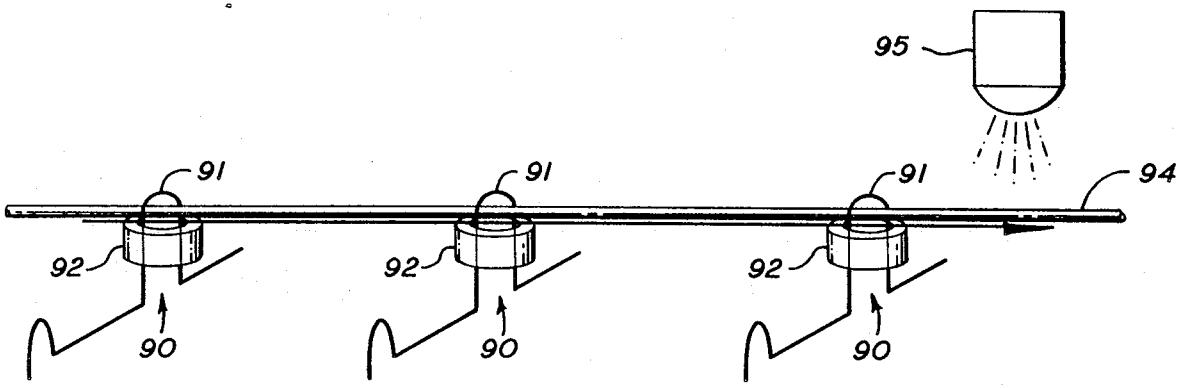
FIG. 7 schematically illustrates the manner in which the manufacturing steps are simplified with the use of a simple conveying means.

The method of manufacture in accordance with the present invention represents an improvement over previous bridge constructions employing relatively complex manufacturing machinery. In accordance with the present invention a simple fixture is used and large numbers of support members can be produced with a single pass through a furnace using a fixture to keep the supports separated or by using a conveyor with the parts spaced apart and suspended on rods or the like. Assembly is further simplified since only one formed part is handled and the part itself holds the insulating material section in place. In this connection refer to FIG. 7 showing one form of lamp filament support construction 90 having a loop protrusion 91 and glass tubing 92 supported thereon. In FIG. 7 a series of support constructions are separated and supported along a conveying rod 94. FIG. 7 also illustrates a heating source at 95. Each of the supports 90 is about to enter the heating sequence upon melting of the glass tubing 92 to form a bead about the base of the loop protrusion. After the beads are formed then the support members may be separated from the conveying rod and the trimming step takes place to preform the desired separate, and isolated wire support sections.

In accordance with the present invention there are many different configurations of support member that can be constructed depending upon the number and locations of the bends in the formed wire. The finished support can be held in place by joining it at any point along its length to some part of the filament or mount assembly. In particular, it may be welded to the molybdenum sealing ribbon or joined to a coil leg by welding or by the use of a coil overwind. Precision formed loops in the wire parts may be fitted around the filament or other lamp parts as required by the particular application. One particularly useful version of the support has a loop formed at both ends of the wire part so the finished support can be attached between coil legs or other lamp parts to secure the orientation of these parts during manufacturing operations such as the press seal operation. Refer in particular to one of the more simplified version of the invention as described in FIGS. 5A–5D herein.

While there have been shown and described what are at present considered the preferred embodiments of the invention, it will be obvious to those skilled in the art that various changes and modifications may be made therein without departing from the scope of the invention as defined by the appended claims.

What is claimed is:

1. A method of constructing a filament support member for providing support for a filament in an electric incandescent lamp, said method comprising the steps of, providing a single-piece preformed refractory metal wire having at least one loop protrusion formed in the wire and positioned between the ends of the wire, with separated first and second sides of the loop, providing a section of insulating material of a type that melts upon application of heat, positioning the section of insulating material over the loop protrusion adjacent the first and second sides with a portion of the loop protrusion extending beyond the section of insulating material, applying heat to melt the section of insulating material to form an insulating bead about and between the first and second sides, and trimming the portion of the loop protrusion extending beyond said insulating bead to interrupt electrical continuity between the first and second sides of said wire and thus electrically isolate the respective ends thereof.

2. The method in claim 1, wherein the insulating material includes an aperture and the loop is threaded through the aperture.

3. The method in claim 1, wherein the insulating material includes at least one slot to admit a wire transverse to the wire axis so the insulating material may be clipped to the wire.

4. The method of claim 1, wherein the loop protrusion forming supports the section of insulating material.

5. The method of claim 1, wherein the loop protrusion includes a transverse base portion forming a wall to position the insulating material against.

6. A method as set forth in claim 1 wherein the loop protrusion extends in a direction substantially transverse to a line joining the ends of the wire.

7. A method as set forth in claim 6 wherein the metal wire is preformed at opposite ends with straight wire sections having the loop protrusion disposed intermediate the straight wire sections.

8. A method as set forth in claim 1 wherein the step of providing a metal wire includes providing a metal wire of molybdenum.

9. A method as set forth in claim 1 wherein the step of providing a metal wire includes providing a metal wire of tungsten.

10. A method as set forth in claim 1 wherein the step of providing a section of insulating tubing includes providing a glass tubing.

11. A method as set forth in claim 1 including providing a conveying means and supporting the wire at the loop protrusion by means of said conveying means during said heating step.

12. A method as set forth in claim 1 wherein the step of trimming includes cutting the metal wire to open the wire between the wire ends.

13. A method as set forth in claim 1 wherein the step of providing a metal wire includes providing a metal wire with a plurality of loop protrusions along the wire length.

14. A method as set forth in claim 13 including providing a plurality of separate tubing pieces and disposing each piece over a corresponding loop protrusion.

15. A method as set forth in claim 1 wherein the step of providing a metal wire includes providing a metal wire with a plurality of loop protrusions disposed in a cross configuration.

16. A filament support member for providing support for a filament in an incandescent lamp and constructed by the process of providing a single-piece preformed refractory metal wire having at least one loop protrusion formed in the wire and positioned between the ends of the wire, providing a section of insulating material of a type that melts upon application of heat thereto, positioned over the loop protrusion with a portion of the loop protrusion extending beyond said insulating material, applying heat to melt the section of insulating material to form an insulating bead, and trimming the portion of the loop protrusion extending beyond said insulating bead to interrupt electrical continuity in said wire and thus electrically isolate the respective ends thereof.

17. A filament support member as set forth in claim 16 wherein the loop protrusion forms a support for the section of insulating material.

18. A filament support member as set forth in claim 16 wherein the loop protrusion includes a blocking portion at the base of said loop protrusion to position the insulating material against.

19. A filament support member as set forth in claim 16 wherein the loop protrusion extends in a direction substantially transverse to a line joining the ends of the wire.

20. A filament support member as set forth in claim 19 wherein the metal wire is preformed at opposite ends with straight wire sections having the loop protrusion disposed intermediate the straight wire section.

21. A filament support member as set forth in claim 16 wherein the metal wire is a molybdenum wire.

22. A filament support member as set forth in claim 16 wherein the metal wire is a tungsten wire.

23. A filament support member as set forth in claim 16 wherein the insulating material is a glass tubing.

24. A filament support member as set forth in claim 16 including providing a conveying means and supporting the wire at the loop protrusion by means of said conveying means during the heating step.

25. A filament support member as set forth in claim 16 wherein the trimming is carried out by cutting the metal wire to open the wire between the wire ends.

26. A filament support member as set forth in claim 16 wherein the metal wire has a plurality of loop protrusions along the wire length.

27. A filament support member as set forth in claim 26 including a plurality of separate insulating material pieces each disposed over a corresponding loop protrusion.

* * * * *